US005462632A

United States Patent [19]

Zacche' et al.

[11] Patent Number: 5,462,632

[45] Date of Patent: Oct. 31, 1995

[54] DEVICE FOR CHANGING THE ANGULAR RELATION BETWEEN A CAROUSEL CONVEYOR AND A KINEMATICALLY-LINKED LABELING GROUP OF A LABELING MACHINE

[75] Inventors: Vanni Zacche', Mantova; Ireneo Orlandi, S. Giorgio di Mantova; Maurizio Pedercini, Marmirolo, all of Italy

[73] Assignee: ALFA Costruzioni Meccaniche S.P.A., Mantova, Italy

[21] Appl. No.: 175,193

[22] Filed: Dec. 28, 1993

[30] Foreign Application Priority Data

Apr. 9, 1993 [IT] Italy ..... PR93A0013

[51] Int. Cl.[6] ..... B65C 9/00

[52] U.S. Cl. ..... 156/566; 156/567; 156/571

[58] Field of Search ..... 156/567, 566, 156/571, 447, 449, DIG. 31

[56] References Cited

U.S. PATENT DOCUMENTS 4,994,135 2/1991 Orlandi ..... 156/362

FOREIGN PATENT DOCUMENTS 2352713 5/1977 France .
3340339 10/1985 Germany .
3918110 1/1990 Germany .
91-14625 10/1991 WIPO .

*Primary Examiner*—James J. Engel
*Attorney, Agent, or Firm*—Darby & Darby

[57] ABSTRACT

A device for changing the angular relation between a carousel conveyor and a label applying apparatus including a support frame to which an internal hollow shaft and an external hollow shaft are mounted, the shafts being coaxial and respectively connected by a cogwheel to the drive shaft of the conveyor and to the drive shaft of the label applying apparatus, the shafts being coupled to each other by a rotatable coaxial joint which moves axially of the shafts.

7 Claims, 1 Drawing Sheet

DEVICE FOR CHANGING THE ANGULAR RELATION BETWEEN A CAROUSEL CONVEYOR AND A KINEMATICALLY-LINKED LABELING GROUP OF A LABELING MACHINE

BACKGROUND OF THE INVENTION

The invention relates to a device for changing the angular relation between a connected carousel conveyor for objects such as containers and bottles which are to be labelled, and a label application means of a labeling machine.

Specifically, but not exclusively, the device is useful in labeling machines where the label application position has to be changed. Such label application is performed by special applicator tools on moving objects on a motorized carousel conveyor. This general arrangement is shown in U.S. Pat. No. 5,190,612, granted Mar. 7, 1993 and which is assigned to the same assignee.

The need to change the label application position arises, for example, in cases where objects of different shapes and sizes are to be labelled. Obviously, the labeling machine label application means is to be repositioned to the new references required by the shape of the new objects. Such a repositioning operation is complicated, however, since the label application means must stay synchronized with the movement of the carousel. It is usually achieved through mechanical transmissions connecting the labeling machine to the carousel motor drive system. At present the label application means is adapted to a new shape of object to be labelled by rephasing the angular position of a drive shaft of the label application means with respect to the drive shaft of the conveyor. Known devices of this type exhibit some drawbacks, however, regarding their constructive complexity, which is due to the fact that they cannot be applied in cases where the label application means can only rotate about a vertical axis.

A principal aim of the present invention is to provide a constructionally simple but economical and practical device which, in a very short time, enables the label application means to be repositioned to correspond with the shape and size of an object transiting on the conveyor.

One advantage of the present invention is that it enables the label application means to be repositioned continuously and without the need to stop the machines.

SUMMARY OF THE INVENTION

These aims and advantages and others besides are all achieved by the device of the invention wherein two coaxial shafts are connected to a joint by means of pawls engaging in guide grooves in the joint.

BRIEF DESCRIPTION OF THE DRAWINGS

Further characteristics and advantages of the present invention will better emerge from the detailed description that follows, of an embodiment of the invention, illustrated in the form of a non-limiting example in the accompanying drawings, in which.

DESCRIPTION OF THE PREFERRED EMBODIMENTS

Figure 1:
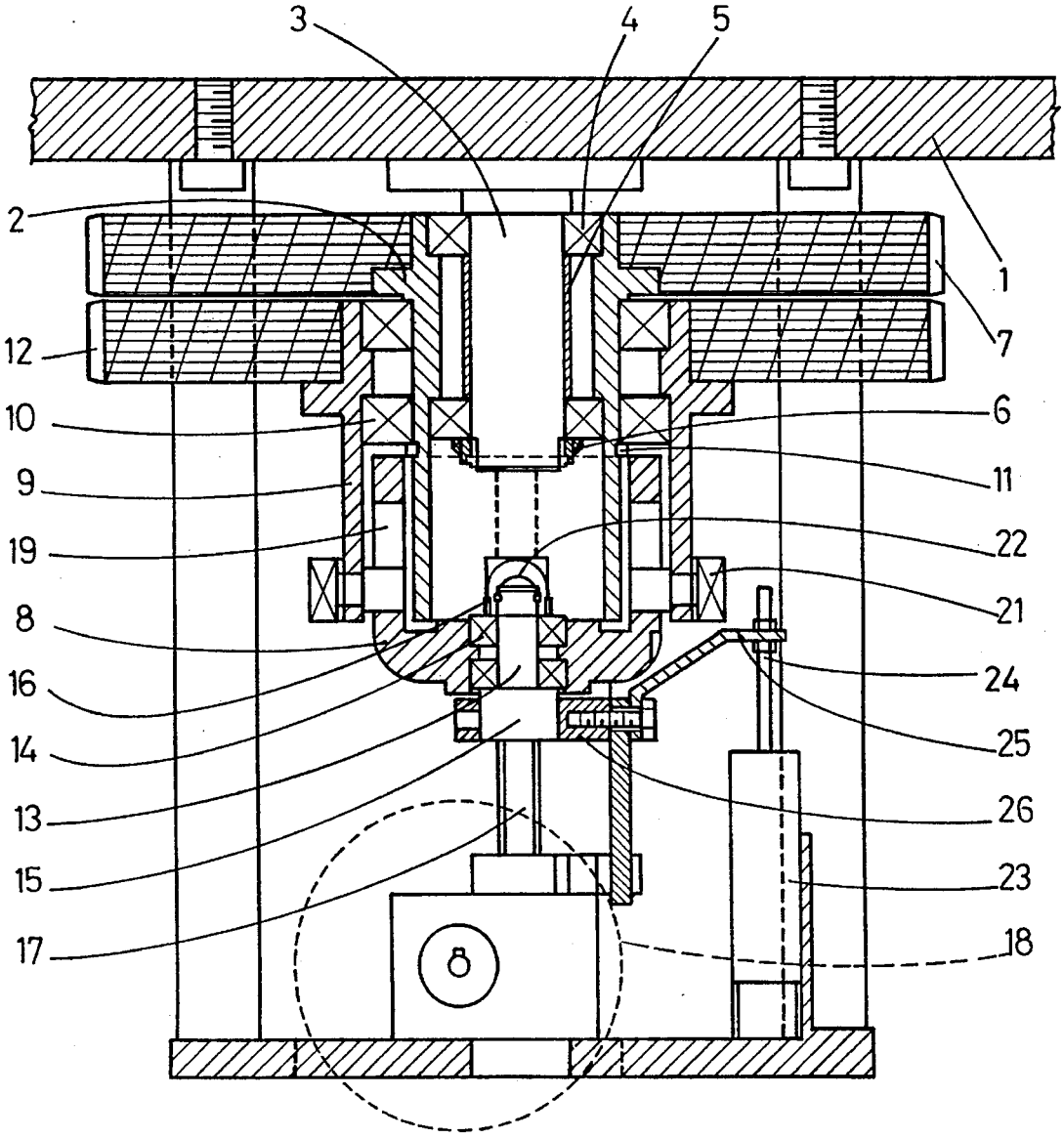
FIG. 1 shows a schematic section in vertical elevation.

With respect to the drawings, 1 denotes a support frame provided with a vertical-axis cylindrical support 3. A first, internal hollow shaft 2 is rotatably coupled to the support 3 by means of bearings 4 distanced by a spacer 5. A collar 6 is screwed on a bottom end of the support 3 to support the first shaft 2. A gear 7 is fixedly keyed on the first shaft 2. Gear 7 meshes through an intermediate direction reversing gear with a gear on the drive shaft of the revolving platform carrying the objects to be conveyed to the labeling machine.

A second, external hollow shaft 9, coaxial to and external of the internal hollow shaft 2, is rotatably coupled to the internal hollow shaft 2 by means of two bearings 10. An elastic safety ring 11, mounted on the internal hollow shaft 2, supports the external hollow shaft 9. A gear 12 is arranged below the gear 7, and is fixedly keyed on the external hollow shaft 9. Gear 12 is to be coupled to a gear on the labeling machine.

The two hollow shafts 2 and 9 are connected to each other by a cup-shaped cylindrical joint 8 which is rotatably coupled to a cylindrical support 13. A pair of bearings 14 permits rotating of the joint 8 about the cylindrical support 13. The lower bearing 14 rests on a shoulder 15. A collar 16 is screwed to the cylindrical support 13 to prevent the cylindrical support 13 from sliding out of the joint 8.

The cylindrical support 13 is rigidly constrained to a vertical-axis screw-jack 17 which is vertically moved by a motor 18 fixed to the base of the frame 1. The screw-jack 17 translation distances are set by a transducer of the potentiometer type 23, provided with a cursor 24 connected to the screw-jack 17 by a rod 25 and a clamp 26.

Figure 2:
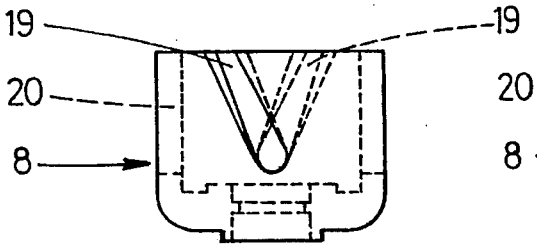
FIG. 2 shows a frontal view of a detail of FIG. 1.
Figure 3:
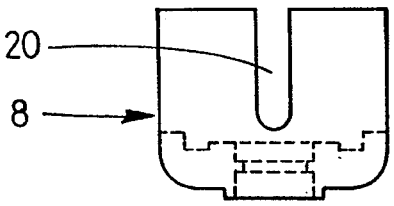
FIG. 3 shows a lateral view of the detail of FIG. 2.

FIGS. 2 and 3 show the structure of the joint 8. On its cylindrical part the said joint 8 has several vertical straight grooves 20 as well as several helical grooves 19, arranged symmetrically with respect to the rotation axis. In the illustrated example the joint has two straight grooves 20 and two helical grooves 19.

The joint 8 is external of the first hollow shaft 2 and internal of the second hollow shaft 9. Two pawls 21 are fixedly connected to the second hollow shaft 9 and arranged symmetrically with respect to the rotation axis. The pawls 21 project internal of the shaft 9 and engage in the helical grooves 19. Two other pawls 22 are fixedly connected to the first hollow shaft 2 and are arranged symmetrically to the rotation axis. The pawls 22 project external of the shaft 2 and engage in the vertical grooves 20. FIG. 1 shows only part of one of the pawls 22.

The device of FIGS. 1–3 is to be connected with applicators of a labeling machine. Precisely, applicators are the parts of the labeling machines such as shown in said U.S. Pat. No. 5,190,612, which applies labels on an object, such as a bottle, as it moves on a conveyor. The gear 12 meshes with a further gear (not shown) connected to a mechanical transmission system of known type, such as a drive shaft, by means of which the label applicator apparatus is activated. The drive motor (not shown) of the labeling machine can be the same as the one which moves the objects to be labeled on the transport line.

The gear 7 transmits the movement that it receives from the drive shaft of the conveyor transport machine to the gear 12 through the coupling joint 8. The movement of the objects to be labeled is thus synchronized with the movements of the applicator tools of the labeling machine. The above applies to objects having the same size and shape.

For objects having varying sizes and shapes, the point of application of labels by the label application tools has to be changed. In order to do this, the reciprocal angular position of the gears 7 and 12 has to be changed. This produces a displacement of the labeling machine transmission downstream of the gear 12 which finally results in a relative displacement of the label applicator tools with respect to the conveyor bearing the objects to be labeled. This relative displacement of the gear 7 and the gear 12 is made possible, even while the same gears 7 and 12 are in movement, by vertical translation of the joint 8, through screw jack 17 activated by the motor 18. During the joint's vertical translation, the pawls 21 and 22 slide one pair in the helical grooves 19 and the other in the vertical grooves 20. The different conformation of the helical and vertical grooves 19 and 20 causes the shafts 2 and 9 to rotate with respect to one another. This rotates the gears 12 and 7 relative to each other resulting through intermediate gears coupled to the drive shafts of the conveyor platform and label application machine an angular displacement of these two drive shafts with respect to each other. The entity of the rotation (deriving from the vertical displacement of the joint 8) is measured by the potentiometer 23. Thus, every different shape of object to be labeled corresponds to a position of the joint 8.

What is claimed:

1. A device for changing an angular relation between the drive shaft of each of a carousel conveyor and a connected labeling machine, comprising:

a support frame;

an inner first hollow shaft and an outer second hollow shaft coaxially mounted to the support frame to rotate about an axis, the first hollow shaft to be coupled to the drive shaft of one of the conveyor and the labeling machine and the second hollow shaft to be coupled to the drive shaft of the other of the conveyor and labeling machine;

a joint coaxial with said first hollow shaft and said second hollow shaft and mounted with freedom to rotate about and move vertically along said axis; said joint having at least one longitudinal guide groove extending in the same direction as said axis and at least one guide groove at an angle to said axis; and at least one pawl connected to said first hollow shaft and at least one pawl connected to said second hollow shaft, said at least one pawl connected to one of said first and second shafts engaging in a respective one of said at least one longitudinal and angled guide grooves;

the said at least one pawl of the other of said first and second shafts engaging in a respective groove of the other of said at least one longitudinal and angled guide grooves; and means for moving said joint along said axis for rotating the angular position of said first and second hollow shafts relative to each other.

2. A device as in claim 1, wherein said means for moving comprise a support to which said joint is rotatably coupled and a screw-jack to which said support is connected activated by a motor to move said jack and said joint parallel to said axis.

3. A device as in claim 2, said means for moving further comprising means for measuring the amount of axial displacement of said joint.

4. A device as in claim 3, wherein said means for measuring compromise a potentiometer and a cursor.

5. A device as in claim 1, further comprising a first gear mounted on said first hollow shaft and a second gear mounted on said second hollow shaft.

6. A device as in claim 1, further comprising:

a first support to which said first hollow shaft is rotatably coupled and first bearing means for coupling said first support to said support frame;

second bearing means for rotatably coupling said second hollow shaft to said first hollow shaft;

said joint being cup shaped and having a cylindrical portion arranged between said first hollow shaft and said second hollow shaft;

said longitudinal and angled guide grooves located on said joint cylindrical portion.

7. A device as in claim 1, wherein said at least one angled guide groove comprises two helical guide grooves arranged symmetrically with respect to said axis and said at least one longitudinal guide grooves comprise two grooves disposed opposite to each other.

* * * * *